US006198453B1

(12) United States Patent
Chew

(10) Patent No.: US 6,198,453 B1
(45) Date of Patent: Mar. 6, 2001

(54) WAVEGUIDE ANTENNA APPARATUS

(75) Inventor: Richard Chew, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/348,739

(22) Filed: Jul. 6, 1999

Related U.S. Application Data

(63) Continuation-in-part of application No. 09/246,200, filed on Jan. 4, 1999.

(51) Int. Cl.[7] ..... H01Q 13/10
(52) U.S. Cl. ..... 343/771; 343/767
(58) Field of Search ..... 343/767, 771, 343/772, 786; H01Q 13/10

(56) References Cited

U.S. PATENT DOCUMENTS 4,328,502 * 5/1982 Scharp ..... 343/771
4,330,784 * 5/1982 Ryno et al. ..... 343/771
5,475,703 * 12/1995 Scalise et al. ..... 372/82

* cited by examiner

*Primary Examiner*—Don Wong
*Assistant Examiner*—Shih-Chao Chen
(74) *Attorney, Agent, or Firm*—David Kalmbaugh

(57) ABSTRACT

A waveguide antenna apparatus which allows accurate and independent control of RF amplitude and phase characteristics while maintaining small, narrow dimensions and a constant external cross-sectional shape. The waveguide antenna apparatus comprises a waveguide section having first and second opposing broad faces, with the first broad face having a continuous curvilinear slot therein, and the second broad face having a continuous ridge thereon. The ridge may vary in width along the length of the waveguide and may also vary in height. The waveguide section generally includes first and second narrow faces. The slot in the first broad face is generally positioned off-center with respect to the waveguide section and is elongated, curvilinear or meandering in shape. Conventional feed and load may be coupled to the waveguide antenna.

11 Claims, 4 Drawing Sheets

WAVEGUIDE ANTENNA APPARATUS

This application is a continuation-in-part of U.S. patent application Ser. No. 09/246,200, filed Jan. 4, 1999.

BACKGROUND OF THE INVENTION

1. Field of the Invention

This invention pertains generally to waveguide antenna devices and methods for propagation of RF energy. More particularly, the invention is a rectangular waveguide antenna apparatus having a continuous slot aperture, a variable height, variable width internal ridge, and a constant external cross section.

2. Description of the Background Art

Numerous types of waveguides are utilized for propagation of electromagnetic energy, typically in the frequency range of between 1 and 150 GHz. Different waveguide cross-sectional shapes and dimensions are selected for distinct electromagnetic field configurations or modes. Rectangular waveguides are widely used for propagation of the transverse electric or $TE_{10}$ mode. In order to optimize the propagation and phase characteristics of waveguides for optimal energy transfer, designers often must use waveguide shapes and dimensions which are difficult and expensive to manufacture, which cause difficulty in mounting the waveguide, or which result in high losses.

U.S. Pat. No. 4,328,502 to Scharp discloses an antenna consisting of a single continues curved-slot in the broad face of a rectangular waveguide which is useful in reducing radiation pattern beamwidth and extending the range of overall slot length. U.S. Pat. No. 4,330,784 to Ryno et al discloses an antenna which is a continuous slot antenna having a rectangular waveguide whose broad dimension varies in proportion to the attenuation for providing an improved radiation pattern. While the antennas disclosed in these patents provide for an enhanced radiation pattern and, in particular, a means for amplitude control of the radiated energy, there is still a need for a waveguide apparatus which allows for independent control of the phase of the radiation pattern while maintaining the rectangular shape of the waveguide.

In addition, there is a need for an antenna having a shape and dimensions which facilitate manufacture and mounting, which allows for accurate control of the propagation constants, and which has low losses. The present invention satisfies these needs, as well as others, and generally overcomes the deficiencies found in the background art.

SUMMARY OF THE INVENTION

The present invention is a waveguide antenna apparatus which allows accurate and independent control of RF amplitude and phase characteristics while maintaining a constant external cross-sectional shape. In general terms, the invention comprises a waveguide section having first and second opposing broad faces, with the first broad face having a continuous slot therein, and the second broad face having a continuous ridge thereon.

By way of example, and not of limitation, the waveguide section generally includes first and second narrow faces. The slot in the first broad face is generally elongated, curvilinear or meandering in shape, and has a generally constant width, although the slot width may vary. Means for inputting RF energy are included adjacent a feed end of the waveguide section, and a resonant or non-resonant load is included at a load end of the waveguide section. The ridge is located on the internal side of the second broad face and extends longitudinally between the feed and load ends of the waveguide section. The ridge dimensions, including the width and the height of the ridge may vary.

In a first embodiment of the invention, the waveguide section is generally rectangular, with the first and second broad faces being generally parallel to each other and generally perpendicular to the narrow faces. In an alternate embodiment of the invention, the waveguide section is "conformarl" or curvilinear in cross sectional shape such that the first broad face, ridge and second broad face define sections of concentric circles, with the first broad face having a radius greater than the ridge, which in turn has a radius greater than the second broad face. The narrow faces are separated by a section of circle having a greater arc than the edges of the ridge. The conformal shape facilitates mounting to an underlying curved surfaces such as missile and aircraft surfaces.

The invention provides a fast wave antenna which is narrow and constant in cross section and which provides very accurate control of radiation along the slot. The waveguide antenna apparatus of the invention may be used for any wavelength for which rectangular waveguides are generally utilized. Amplitude and phase are controlled independently while maintaining a constant external cross section for the waveguide. The internal cross-section of the waveguide generally varies according to variations in the dimensions of the ridge on the internal surface of the second broad face. The internal ridge compresses the "a" dimension of the waveguide which, in equivalent circuit terms, serves to act like an artificial dielectric which provides additional capacitance to the transmission line. Adjusting the height and/or the width of the ridge within the waveguide allows optimization of antenna performance, provides for independent phase control, allows handling of a wider frequency bandwidth, and allows for accurate control of the waveguide phase and propagation constants. Adjustment of the length, position and shape of the slot allows control of main beam width, amplitude distribution, and side lobe level (SLL). Adjustment of the "a" dimension allows control of the antenna look angle. Very accurate amplitudes and phases can be achieved so that a high gain, high effective, very narrow beam width can be realized in production. SLL in excess of −30 dB can be achieved for short slot length of ten wavelength or less.

An object of the invention is to provide a waveguide antenna apparatus which allows accurate and independent control of RF amplitude and phase characteristics.

Another object of the invention is to provide a waveguide antenna apparatus which has a constant external cross-sectional shape.

Another object of the invention is to provide a waveguide antenna apparatus which is quick and easy to manufacture.

Another object of the invention is to provide a waveguide antenna apparatus that has an external shape which facilitates mounting of the antenna on surfaces.

Another object of the invention is to provide a waveguide antenna apparatus which allows accurate and independent control of amplitude and phase characteristics.

Another object of the invention is to provide a waveguide antenna apparatus which allows small and narrow waveguide structures.

Another object of the invention is to provide a waveguide antenna apparatus which can operate at very high temperatures.

Further objects and advantages of the invention will be brought out in the following portions of the specification, wherein the detailed description is for the purpose of fully disclosing the preferred embodiment of the invention without placing limitations thereon.

BRIEF DESCRIPTION OF THE DRAWINGS

The present invention will be more fully understood by reference to the following drawings, which are for illustrative purposes only.

DETAILED DESCRIPTION OF THE PREFERRED EMBODIMENTS

Referring more specifically to the drawings, for illustrative purposes the present invention is embodied in the apparatus shown FIG. 1 through FIG. 11. It will be appreciated that the apparatus may vary as to configuration and as to details of the parts without departing from the basic concepts as disclosed herein.

Figures 1, 2, 3, 4, 5, 6:
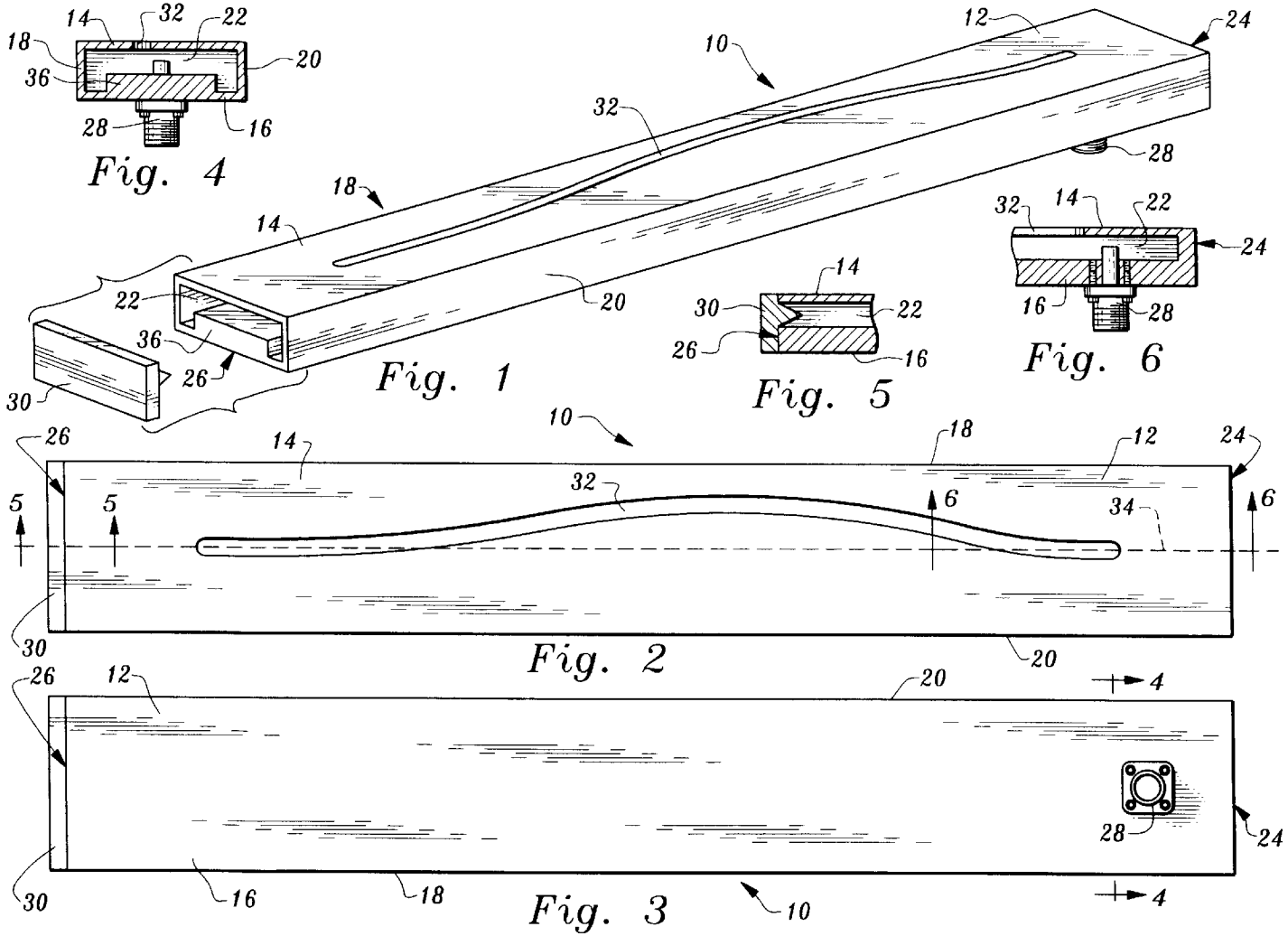
FIG. 1 is a perspective view of a waveguide antenna apparatus in accordance with the invention, shown with the load detached from the antenna end.
FIG. 2 is a top plan view of the waveguide antenna apparatus of FIG. 1 shown with the load coupled to the antenna end.
FIG. 3 is a bottom plan view of the waveguide antenna apparatus of FIG. 2.
FIG. 4 is a cross-sectional view of the waveguide antenna apparatus of FIG. 3 shown through line 4—4.
FIG. 5 is a partial cross-sectional view of the waveguide antenna apparatus of FIG. 2 shown through line 5—5.
FIG. 6 is a partial cross-sectional view of the waveguide antenna apparatus of FIG. 2 shown through line 6—6.

Referring first to FIG. 1 through FIG. 6, a rectangular embodiment waveguide antenna apparatus 10 in accordance with the invention is generally shown. Waveguide antenna 10 includes an elongated waveguide section 12 of rectangular shape, with a first broad face 14 and a second broad face 16, and a first narrow face 18 and a second narrow face 20. First and second broad faces 14, 16 are positioned opposite each other and are generally parallel to each other and perpendicular to first and second narrow faces 18, 20 such that a rectangular cross-sectional shape is defined for waveguide antenna 10. First and second narrow faces 18, 20 are likewise generally opposite and parallel to each other, and perpendicular to broad faces 14, 16. Broad faces 14, 16 and narrow faces 18, 20 define an elongated internal waveguide cavity 22. Waveguide section 12 also has a feed end 24 and a load end 26, with waveguide cavity 22 extending between feed end 24 and load end 26. Feed end 24 is generally closed as shown in FIG. 6, while load end 26 may remain open or closed depending upon the particular use of the invention.

Means for introducing radio frequency or RF electromagnetic energy to waveguide section 12 are included proximate or adjacent to feed end 24, and are shown as a conventional, commercially available feed in the form of a threaded coaxial cable connector or jack 28. Means for coupling a load to load end 26 are also provided in the form of a conventional, commercially available load 30, which is structured and configured to slidably engage internal waveguide cavity 22 at the load end 26. Load 30 is shown as tapered in shape, although loads of stepped shape or other configurations may also be used with the invention. The location of the closed feed end 26 is selected to match the feed 28 to optimize transfer of energy from the feed 28 to the antenna 10.

A continuous, elongated slot or channel 32, which is non-resonant, is included in the first broad face 14 of waveguide section 12. Slot 32 extends through first broad face 14 to communicate with waveguide cavity 22. Slot 32 is shown as curvilinear or meandering in shape, and with the ends of slot 32 generally located on a centerline 34 of first broad face 14 and waveguide antenna 10. The shape, width and position of slot 32 will generally vary depending upon the particular application of waveguide antenna 10. Design considerations for the structure and configuration of slot 32 are discussed further below. Accurate control of amplitude radiation along slot 32 is provided by the curvilinear shape of slot 32 which is illustrated in FIG. 2.

An elongated ridge 36 is included on second broad face 16, with ridge 36 internally located within waveguide cavity 22 and extending generally between feed end 24 and load end 26. Ridge 36 is shown as integral to broad face 16, and as rectangular in shape and generally centrally located on second broad face 16. The structure, configuration and location of ridge 36 will generally vary according to the particular applications of the invention, and design considerations for ridge 36 are discussed further below.

Figures 7, 8, 9:
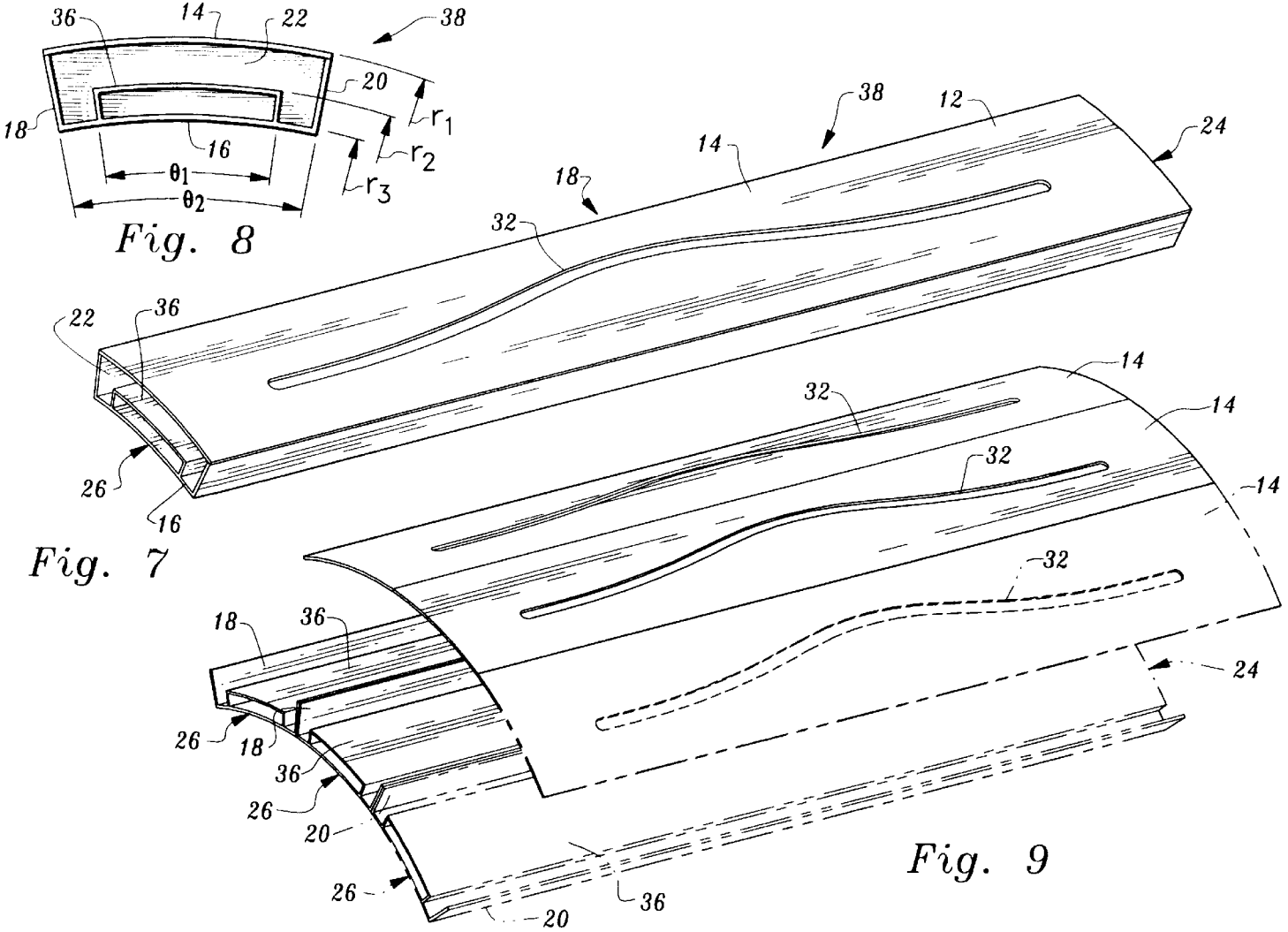
FIG. 7 is a perspective view of an alternative embodiment waveguide antenna apparatus in accordance with the invention.
FIG. 8 is an end view of the waveguide antenna apparatus of FIG. 7.
FIG. 9 is an exploded view of three of the waveguide antenna apparatus of FIG. 7 positioned adjacent to each other.

Referring next to FIG. 7 through FIG. 9, an alternative embodiment waveguide antenna apparatus 38 is shown, wherein like reference numerals denote like parts. Waveguide antenna apparatus 38 has a waveguide section 12 of "conformal" or curvilinear cross-sectional shape to facilitate mounting of the apparatus 38 on correspondingly curved shapes, such as the surfaces of missiles, aircraft or spacecraft. First broad face 14, the surface of ridge 36, and second broad face 16 each define an arc or section of concentric circles having radii of $r_1$, $r_2$, $r_3$ respectively as shown in FIG. 8, with $r_1>r_2,>r_3$. The separation of first and second narrow faces 18, 20 is generally defined by a circular section or arc having an angle $è_1$, and the width of ridge 36 is generally defined by a circular section or arc having an angle $è_2$, with $è_1 > è_2$. A curvilinear slot 32 in broad face 14 communicates with internal waveguide cavity 22. Ridge 36 on broad face 16 faces inward and extends between feed end 24 and load end 26. Waveguide antenna apparatus 38 is shown without attached feed or load, but these items may be included on waveguide antenna apparatus as described above.

Referring again to FIG. 1 through FIG. 6 as well as FIG. 7 through FIG. 9, the broad faces 14, 16, narrow faces 18, 20, ridge 36 and end 26 of waveguide antenna apparatus 38 and 10 are preferably fabricated from conductive metal or metal alloy. The waveguide properties of the apparatus 10 are controlled by the shape and dimensions of waveguide cavity 22 and slot 32. The thickness and external shape of broad face 16 and narrow faces 18, 20 can generally be varied depending upon the particular application of the invention. Waveguide antenna apparatus 38 is shown as structured and configured with relatively thin broad faces 14, 16 and narrow faces 18, 20, and with ridge 36 being generally hollow rather than solid as shown in the apparatus 10 above. The thinner construction of waveguide antenna apparatus 38 is consistent with fabrication from thin sheet metal, and is generally preferred for aircraft, spacecraft, missile and other applications wherein minimal weight is an important consideration. Waveguide antenna apparatus 38 may be resilient, but flexing of the apparatus 10 is generally undesirable and will result in radiation losses. The waveguide antenna apparatus 10 is shown with a generally solid ridge 36 integral to broad face 16, in a manner consistent with fabrication by extrusion or "pultrusion." The solid ridge 36 integral to broad face 16 provides increased mechanical strength and robustness for mechanically challenging applications where weight considerations are less important.

Figure 10:
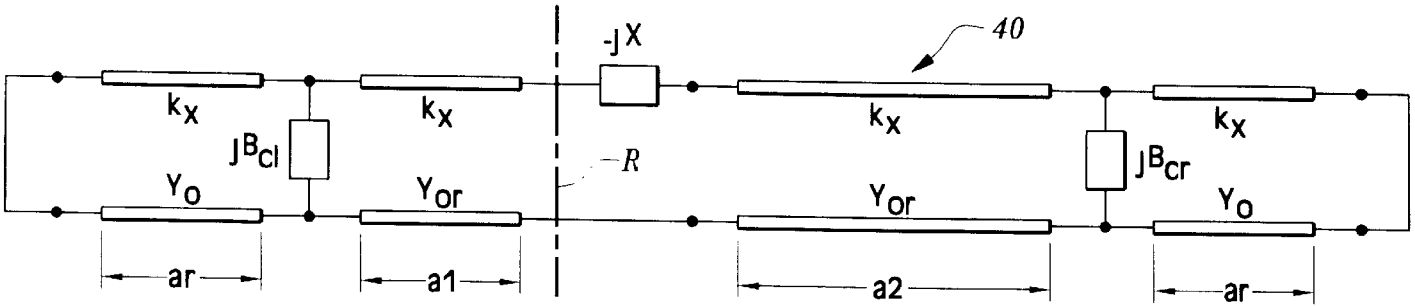
FIG. 10 is a schematic of an equivalent circuit corresponding to the cross-sectional dimensions of the waveguide antenna apparatus of the invention.
Figure 11:
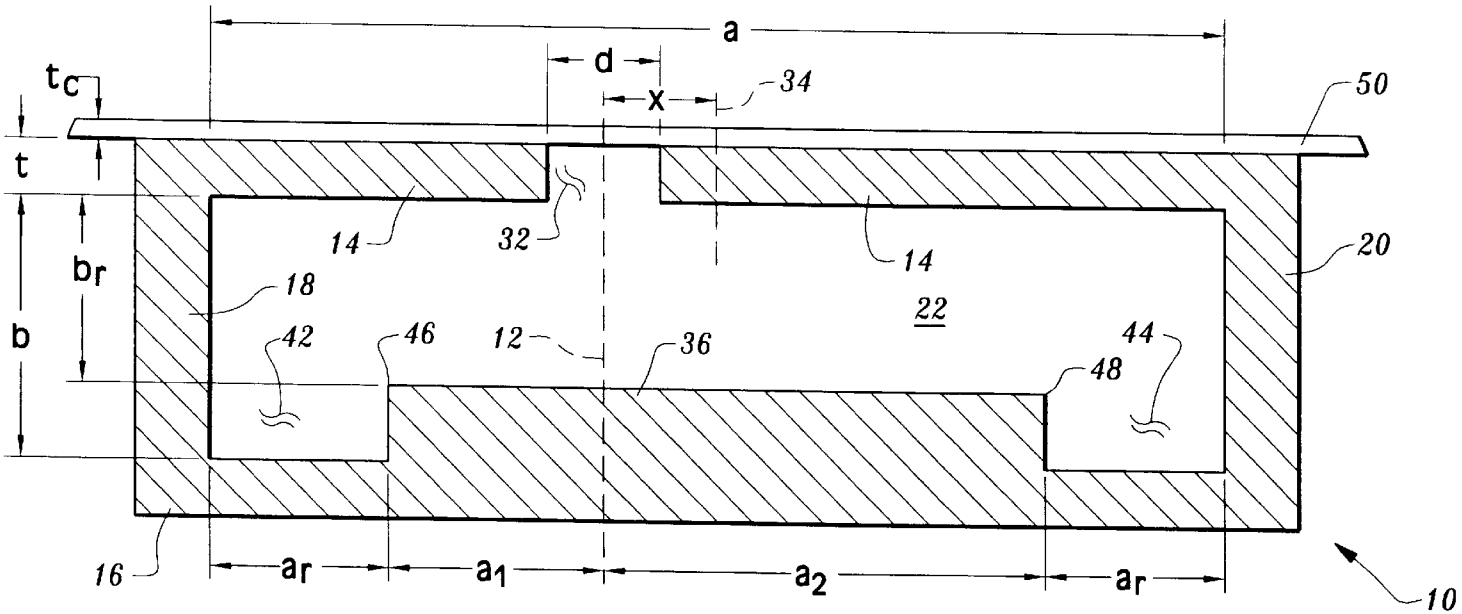
FIG. 11 is a cross-sectional view of the waveguide antenna apparatus corresponding to the equivalent circuit schematic of FIG. 10.

Referring now to FIG. 10 and FIG. 11, there is shown a schematic diagram of an equivalent circuit 40 and the corresponding cross-sectional shape and dimensions of the waveguide antenna apparatus 10. According to convention in the waveguide antenna art, the internal dimensions of waveguide antenna apparatus 10 are shown in FIG. 10 as the "a" dimension (horizontal) between the narrow faces 18, 20 and the "b" dimension (vertical) between the broad faces 14, 16.

The internal ridge 36 compresses the "a" dimension of the waveguide antenna apparatus 10 and acts like an artificial dielectric which provides additional capacitance to equivalent circuit 40. Ridge 36 defines a pair of troughs, "valleys" or channels 42, 44 within waveguide cavity 22, with channel 42 positioned between narrow face 18 and shoulder 46 of ridge 36, and with channels 44 positioned between narrow face 20 and shoulder 48 of ridge. Channels 42, 44 are shown as each having the same width $a_r$, although the width of channels 42, 44 need not be the same, depending upon the dimensions and position of ridge 36 within waveguide cavity 22. Slot 32 is shown as positioned off center relative to center line 34 of waveguide antenna apparatus 10. Slot 32 has a width "d." The distance between waveguide centerline 34 and the outer edge of slot 32 is defined by "x." A reference plane R is shown at the center of slot 32. The "a" dimension of ridge 36 to the left of reference plane R is designated as $a_1$, while the "a" dimension of ridge to the right of reference plane R is shown as $a_2$. Waveguide antenna apparatus 10 is shown with an external dielectric coating or skin 50 having thickness $t_c$ and known dielectric permeability and permittivity.

In equivalent circuit 40, the reactances $Y_o$ correspond to channels 42, 44 of width $a_r$, and the reactances associated with the portions of ridge of dimensions $a_1$ and $a_2$ are shown as $Y_{or}$. The value $k_x$ is the corresponding transverse plane wave number which is obtained under the $TE_{10}$ transverse resonance condition in a standard manner. The dimensions of slot 32 and thickness $t_c$ and dielectric properties of coating 50 provide a complex capacitance parameter $-jX$ to equivalent circuit 40. Shoulders 46, 48 of ridge 38 provide complex capacitance parameters $jB_{cl}$ and $jB_{cr}$ to equivalent circuit 40. Generally, $B_{cl}=B_{cr}$ for a symmetrical ridge 36, and the equivalent circuit parameters are related by $$\frac{B_{cl}}{Y_o}=\frac{B_{cr}}{Y_o}=\frac{2b}{\lambda_g}\left[\ln\left(\frac{1+\alpha}{1-\alpha}\right)^{1/2\left(\alpha+\frac{1}{\alpha}\right)}+2\left(\frac{A+A_r+2C}{AA_r-C^2}\right)\right]+\left[\left(\frac{b}{4\lambda_g}\right)^2\left(\frac{1-\alpha}{1+\alpha}\right)^{4\alpha}\left(\frac{5\alpha-1}{1-\alpha^2}+\frac{4}{3}\alpha^2\frac{C}{A}\right)^2\right]. \quad \text{Equation (1)}$$

Where $\lambda_g$ is the radiation wavelength within waveguide apparatus 10, $$\lambda_g=\overline{\cos\theta\sqrt{1}}$$

$$A=\left(\frac{1+\alpha}{1-\alpha}\right)^{2\alpha}1+\frac{\sqrt{1-\left(\frac{b}{\lambda_g}\right)^2}}{1-\sqrt{1-\left(\frac{b}{\lambda_g}\right)^2}}-\frac{1+3\alpha^2}{1-\alpha^2},$$

$$A_r=\left(\frac{1+\alpha}{1-\alpha}\right)^{2\alpha}1+\frac{\sqrt{1-\left(\frac{b^r}{\lambda_g}\right)^2}}{1-\sqrt{1-\left(\frac{b^r}{\lambda_g}\right)^2}}-\frac{1+3\alpha^2}{1-\alpha^2},$$

and $$C=\left(\frac{4\alpha}{1-\alpha^2}\right)^2.$$

Equation (1) was obtained by the equivalent static method employing a static aperture field due to the incidence of the two lowest modes and is generally correct to within 1% in the range $b/\lambda_g<1$. Equation (1) and the numerical results therefrom are discussed in additional detail in the "Waveguide Handbook" by N. Marcuvits at pages 307–309, the disclosure of which is incorporated herein by reference.

The aforementioned equivalent circuit parameters can be approximated by $$\frac{B_{cl}}{Y_o}=\frac{B_{cr}}{Y_o}\approx\frac{2b}{\lambda_g}\left[\ln\left(\frac{1-\alpha}{4\alpha}\right)\left(\frac{1+\alpha}{1-\alpha}\right)^{1/2\left(\alpha+\frac{1}{\alpha}\right)}+\frac{2}{A}\right], \quad \text{Equation (2)}$$

and where $\alpha<<1$, $$\frac{B_{cl}}{Y_o}=\frac{B_{cr}}{Y_o}\approx\frac{2b}{\lambda_g}\left[\ln\frac{e}{4\alpha}+\frac{\alpha^2}{3}+\frac{1}{2}\left(\frac{b}{\lambda_g}\right)2(1-\alpha^2)^4\right]. \quad \text{Equation (3)}$$

The approximations provided by equation (2) and equation (3) are also disclosed in Marcuvitz's "Waveguide Handbook" together with graphic representations of the numerical results therefrom.

Figure 12:
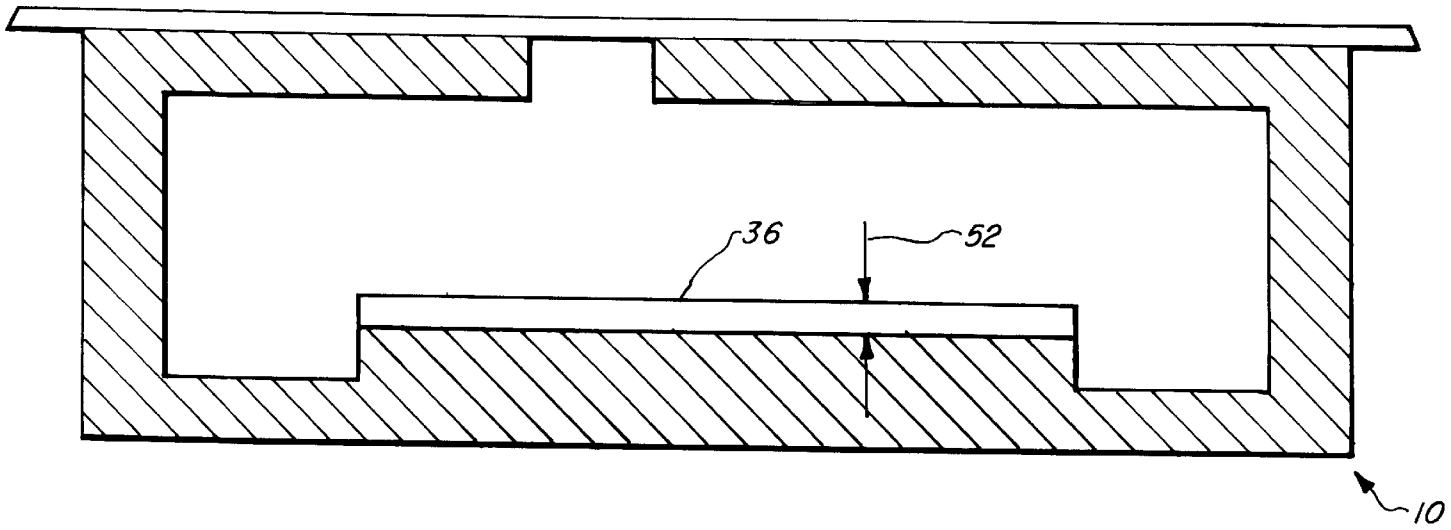
FIG. 12 is a cross-sectional view of the waveguide antenna apparatus of FIG. 1 wherein the height of the ridge varies along the length thereof
Figure 13:
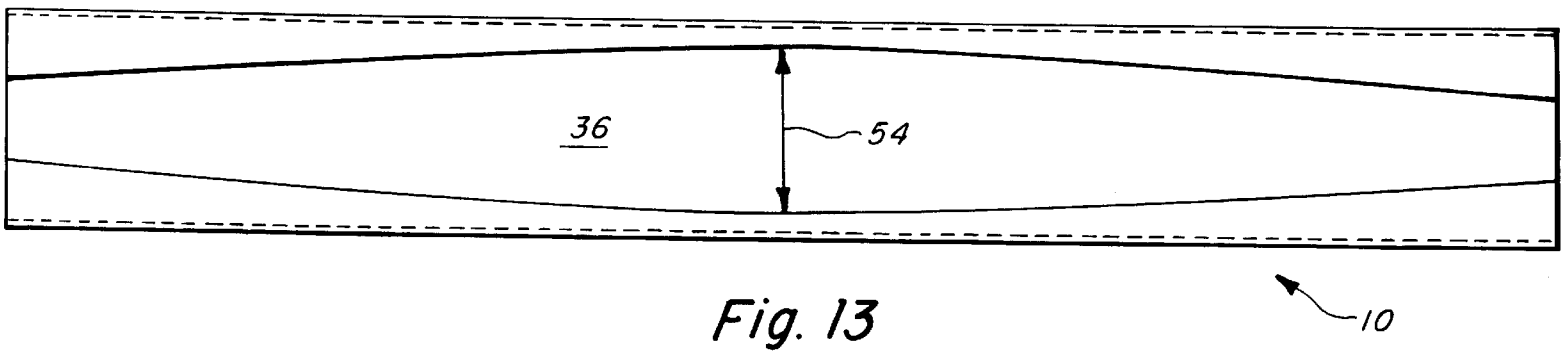
FIG. 13 is a cross-sectional view of the waveguide antenna apparatus of FIG. 1 wherein the width of the ridge varies along the length thereof

Referring to FIGS. 12 and 13, FIG. 12 illustrates the ridge 36 having a variable height along its length with the height differential between the low point and high point of ridge 36 within waveguide 10 being designated generally by the reference numeral 52. Similarly, FIG. 13 illustrates the width of ridge 36 having a varying dimension along the length thereof with the maximum width for ridge 36 being approximately at the center of waveguide 10, as indicated generally by the reference numeral 54. By varying the height and/or the width of ridge 36 along its length in the manner illustrated in FIGS. 12 and 13 a constant phase for the electromagnetic energy being transmitted through waveguide 10 can be maintained without a loss of efficiency of waveguide 10, that is the efficiency of waveguide 10 can be maintained at approximately 97 percent.

Adjusting the height and width of the ridge 36 also allows adjustment of complex capacitance parameters $jB_{cl}$ and $jB_{cr}$ in equivalent circuit 40 for optimization of antenna performance and to allow handling of a wider frequency bandwidth and accurate control of the waveguide phase and propagation constants. The adjustment of complex capacitance parameters $jB_{cl}$ and $jB_{cr}$ for waveguide antenna 38 is similar, with the additional consideration of the curvature of broad faces 14, 16 being taken into account.

The variable height of ridge 36 (illustrated in FIG. 12); the variable width of ridge 36 (illustrated in FIG. 13) and the curvilinear shape of slot 32 (illustrated in FIG. 2) provide a waveguide antenna 10 which has three degrees of freedom which may be used to maintain a constant amplitude and a constant phase for the microwave signal emitted by the antenna. This, in turn, allows for independent control of the amplitude and phase of the emitted signal, while maintaining a constant external cross section for waveguide 10 along the length of slot 32 which is required when mounting waveguide 10 on a missile, aircraft or other military vehicle. In addition, adjusting the height and the width of ridge 36 allows the user of waveguide 10 to operate waveguide 10 over a wider frequency bandwidth of the microwave frequency range of the electromagnetic spectrum than would be possible using a rectangular shaped waveguide without a ridge.

The desired look angle θ of the waveguide antenna apparatus 10 is obtained by control of the "a" dimension. Generally, for a given look angle in the equivalent $TE_{10}$ or dominant mode for a ridged waveguide, $$\lambda_g = \frac{\lambda}{\sqrt{1-\left(\frac{\alpha\lambda}{\lambda_c}\right)^2}}, \qquad \text{Equation (3)}$$

where

λ is the wavelength in air or free space, $\lambda_c$ is the cut off wavelength of the ridge waveguide, $\lambda_g$ is the waveguide wavelength, and α is the waveguide attenuation constant.

Thus, for waveguide antenna apparatus 10 with internal width "a," the desired look angle θ is defined by $$\theta = \alpha\cos\left(\frac{\lambda_g}{\lambda}\right). \qquad \text{Equation (4)}$$

The control of waveguide antenna width for selecting desired look angles is well known and is discussed in additional detail in U.S. Pat. No. 4,330,784 to Ryno et al., the disclosure of which is incorporated herein by reference. Look angle control for waveguide antenna 38 are similar, with the additional consideration of the curvature of broad faces 14, 16 being taken into account The length of slot 32 for waveguide antenna apparatus 10 is selected to provide a desired main beam width, and the amplitude distribution and side lobe level (SLL) of waveguide antenna apparatus 10 are controlled by the off-center positioning of slot 32. Location of slot 32 off-center generally increases the waveguide phase constant β, but this phase constant can be controlled by the shape of slot 32 and ridge 36. The general $TE_{10}$ design considerations for slot 32 are related by $$X(i) = \frac{\alpha}{\pi}\arcsin\left(\frac{1}{K^2}\left[\frac{CPi\frac{\Delta}{L}}{1-C\frac{\Delta}{L}\sum_{j=0}^{i}P\left(\frac{j\Delta}{L}\right)}\right]\right)^{1/2}, \qquad \text{Equation (5)}$$

where

X is the amount of offset of slot 32 from waveguide centerline 34 at any point i along slot 32, i=0–1000, a is the broad face width of waveguide cavity 22, L is the length of slot 32, $$K^2 = \frac{2d\lambda\lambda_g L}{b\lambda_c 3},$$

b is the narrow face width of waveguide cavity 22, d is the width of slot 32, λ is wavelength in air or free space, $\lambda_g$ is the waveguide wavelength, $\lambda_c$ is determined by the solution of the equivalent circuit of FIG. 10, Δ/L is the incremental distance along waveguide antenna apparatus 10 normalized to the length of slot 32, P is the radiated aperture power distribution as a function of distance along slot 32, $$C = \frac{\eta}{\int_0^1 P(\xi)\,d\xi} \cong \frac{\eta}{\frac{\Delta}{L}\sum_{i=0}^{L/\Delta}P\left(\frac{i\Delta}{L}\right)},$$

η is antenna efficiency, and

ξ is the fraction of distance along slot 32.

The design considerations for slotted waveguide antennas are described in additional detail in U.S. Pat. No. 4,328,502 to Scharp, the disclosure of which is incorporated herein by reference. The width d of slot 32 needs to be varied to control the phase constant β of waveguide antenna apparatus 10. Slot width d can be calculated from the equation for $K^2$ above. Very accurate amplitudes and phases for waveguide antenna apparatus 10 can be achieved so that a high gain, highly effective, very narrow beam width can be realized, with SLL in excess of −30 dB can achievable for short slot lengths of ten wavelengths or less.

Referring now to FIGS. 1, 2, 11, 12 and 13, a user of waveguide 10 selects a frequency of operation for waveguide 10. The slot length for slot 32 of waveguide 10 is selected by the user to provide the desired main beam width for the RF signal emitted by the antenna. The user of waveguide 10 then selects the "a" dimension (FIG. 11) to provide the look angle for waveguide 10. Amplitude distribution for waveguide 10 is selected to provide a desired side lobe level with the user providing the amplitude distribution for waveguide 10 by positioning slot 32 of waveguide off the centerline 34 of broad face 14. As slot 32 moves from centerline 34 as shown in FIG. 2, phase propagation increases. To make phase propagation for waveguide 10, the user may vary the width of ridge 36 in the manner illustrated in FIG. 13. The user also has the option of varying the height of ridge 36 along its length as shown in FIG. 12 to make phase propagation constant. In addition, the user may vary the height and the width of ridge 36 to maintain phase propagation constant. Side lobe levels in excess of −30 dB for the transmitted RF signal can be achieved by waveguide 10 for a slot length for slot 32 of 10 wavelengths or less.

The waveguide antenna apparatus 10 and 38 of the invention allow smaller and narrower waveguide structures than have been previously available. The presence of an internal ridge on one of the broad faces eliminates the need for varying the "a" dimension in a manner which has made prior art waveguide antennas difficult and expensive to manufacture and mount.

Accordingly, it will be seen that this invention provides a waveguide antenna apparatus which allows accurate and independent control of RF amplitude and phase characteristics, and provides relatively small, narrow waveguide structures while maintaining a constant external cross-sectional shape. Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A waveguide antenna apparatus for transmitting Radio Frequency energy, comprising:

(a) a waveguide section, said waveguide section including a first broad face and a second broad face and a cavity formed between said first broad face and said second broad face;

(b) said first broad face having a continuous curvilinear slot therein;

(c) said second broad face including a ridge internally located within the cavity of said waveguide section, said ridge extending the length of said waveguide section;

(d) the broad dimension of said ridge being varied along the length of said waveguide section, said ridge having a maximum width at approximately a center point of said waveguide section (e) said waveguide section having a constant external cross-section shape along the length of said waveguide section;

(f) said waveguide section having a feed end positioned at one end thereof and a load end positioned at an opposite end thereof;

(g) the curvilinear slot of said waveguide section allowing a constant amplitude to be maintained for said Radio Frequency energy radiated from said waveguide section;

(h) the varying broad dimension of the ridge of said waveguide section allowing a constant phase to be maintained for said Radio Frequency energy radiated from said waveguide section;

(i) the cross-sectional shape of said waveguide section corresponding to an equivalent circuit which includes a pair of complex capacitance parameters $iB_{cl}$ and $jB_{cr}$ corresponding to a pair of shoulders positioned on each side of said ridge, said complex capacitance parameters $jB_{cl}$ and $jB_{cr}$ being related by the following expression when $B_{cl}=B_{cr}$ for a symmetrical ridge;

$$\frac{B_{cl}}{Y_o} = \frac{B_{cr}}{Y_o} = \frac{2b}{\lambda_g}\left[\left(\ln\left(\frac{1+\alpha}{1-\alpha}\right)\right)^{1/2\left(\alpha+\frac{1}{\alpha}\right)} + 2\left(\frac{A+A_r+2C}{AA_r-C^2}\right)\right] +$$

-continued $$\left[\left(\frac{b}{4\lambda_g}\right)^2\left(\frac{1-\alpha}{1+\alpha}\right)^{4\alpha}\left(\frac{5\alpha-1}{1-\alpha^2}+\frac{4}{3}\frac{\alpha^2 C}{A}\right)^2\right]$$

Where $\lambda_g$ is the radiation wavelength within said waveguide antenna apparatus.

$$\lambda_g = \overline{\cos\theta\sqrt{1}}$$

$$A = \left(\frac{1+\alpha}{1-\alpha}\right)^{2\alpha} 1 + \frac{\sqrt{1-\left(\frac{b}{\lambda_g}\right)^2}}{1-\sqrt{1-\left(\frac{b}{\lambda_g}\right)^2}} - \frac{1+3\alpha^2}{1-\alpha^2},$$

$$A_r = \left(\frac{1+\alpha}{1-\alpha}\right)^{2\alpha} 1 + \frac{\sqrt{1-\left(\frac{b^r}{\lambda_g}\right)^2}}{1-\sqrt{1-\left(\frac{b^r}{\lambda_g}\right)^2}} - \frac{1+3\alpha^2}{1-\alpha^2},$$

and $$C = \left(\frac{4\alpha}{1-\alpha^2}\right)^2.$$

2. The waveguide antenna apparatus as recited in claim 1, wherein said curvilinear slot is a non-resonant curvilinear slot.

3. The waveguide antenna apparatus as recited in claim 1, further comprising:

(a) means for introducing said radio frequency energy to said waveguide section, said means for introducing said radio frequency energy positioned adjacent said feed end; and (b) means for coupling a load to said waveguide section, said load coupling means positioned adjacent said load end.

4. The waveguide antenna apparatus as recited in claim 1, wherein said waveguide section further comprises first and second narrow faces.

5. The waveguide antenna apparatus as recited in claim 1, wherein said waveguide section is rectangular in cross-sectional shape, with said first broad face parallel to said second broad face.

6. A waveguide antenna apparatus for transmitting Radio Frequency energy, comprising:

(a) a waveguide section, said waveguide section including a first broad face and a second broad face and a cavity formed between said first broad face and said second broad face;

(b) said first broad face having a continuous curvilinear slot therein;

(c) said second broad face including a ridge internally located within the cavity of said waveguide section, said ridge extending the length of said waveguide section;

(d) the broad dimension of said ridge being varied along the length of said waveguide section, said ridge having a maximum width at approximately a center point of said waveguide section;

(e) the height of said ridge being varied along the length of said waveguide section;

(f) said waveguide section having a constant external rectangular cross-section shape along the length of said waveguide section;

(g) the curvilinear slot of said waveguide section allowing a constant amplitude to be maintained for said Radio Frequency energy radiated from said waveguide section; and (h) the varying broad dimension and the height of the ridge of said waveguide section allowing a constant phase to be maintained for said Radio Frequency energy radiated from said waveguide section;

(i) the cross-sectional shape of said waveguide section corresponding to an equivalent circuit which includes a pair of complex capacitance parameters $jB_{cl}$ and $jB_{cr}$ corresponding to a pair of shoulders positioned on each side of said ridge, said complex capacitance parameters $jB_{cl}$ and $jB_{cr}$ being related by the following expression when $B_{cl}=B_{cr}$ for a symmetrical ridge:

$$\frac{B_{cl}}{Y_o} = \frac{B_{cr}}{Y_o} = \frac{2b}{\lambda_g}\left[\left(\ln\left(\frac{1+\alpha}{1-\alpha}\right)\right)^{1/2\left(\alpha+\frac{1}{\alpha}\right)} + 2\left(\frac{A+A_r+2C}{AA_r-C^2}\right)\right] + \left[\left(\frac{b}{4\lambda_g}\right)^2\left(\frac{1-\alpha}{1+\alpha}\right)^{4\alpha}\left(\frac{5\alpha-1}{1-\alpha^2}+\frac{4}{3}\frac{\alpha^2 C}{A}\right)^2\right]$$

Where $\lambda_g$ is the radiation wavelength within said waveguide antenna apparatus, $$\lambda_g = \overline{\cos\theta\sqrt{1}}$$

$$A = \left(\frac{1+\alpha}{1-\alpha}\right)^{2\alpha} 1 + \frac{\sqrt{1-\left(\frac{b}{\lambda_g}\right)^2}}{1-\sqrt{1-\left(\frac{b}{\lambda_g}\right)^2}} - \frac{1+3\alpha^2}{1-\alpha^2},$$

$$A_r = \left(\frac{1+\alpha}{1-\alpha}\right)^{2\alpha} 1 + \frac{\sqrt{1-\left(\frac{b^r}{\lambda_g}\right)^2}}{1-\sqrt{1-\left(\frac{b^r}{\lambda_g}\right)^2}} - \frac{1+3\alpha^2}{1-\alpha^2},$$

-continued and $$C = \left(\frac{4\alpha}{1-\alpha^2}\right)^2.$$

7. The waveguide antenna apparatus as recited in claim 6, wherein said waveguide section includes a feed end and a load end.

8. The waveguide antenna apparatus as recited in claim 6, further comprising:

(a) means for introducing said radio frequency energy to said waveguide section, said means for introducing said radio frequency energy positioned adjacent said feed end; and (b) means for coupling a load to said waveguide section, said load coupling means positioned adjacent said load end.

9. The waveguide antenna apparatus as recited in claim 6, wherein said waveguide section further comprises first and second narrow faces.

10. The waveguide antenna apparatus as recited in claim 6, wherein said waveguide section provides side lobe levels greater than −30 dB for a radio frequency signal emitted by said waveguide section.

11. The waveguide antenna apparatus as recited in claim 6, wherein said curvilinear slot comprises a non-resonant curvilinear slot.

* * * * *